US008043056B2

(12) United States Patent
Horng et al.

(10) Patent No.: US 8,043,056 B2
(45) Date of Patent: Oct. 25, 2011

(54) SELF-ASSEMBLY MICRO FAN

(75) Inventors: Alex Horng, Kaohsiung (TW); I-Yu Huang, Kaohsiung (TW); Yen-Chi Li, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 457 days.

(21) Appl. No.: 12/398,212

(22) Filed: Mar. 5, 2009

(65) Prior Publication Data

US 2009/0202349 A1 Aug. 13, 2009

Related U.S. Application Data

(63) Continuation-in-part of application No. 12/068,578, filed on Feb. 8, 2008.

(51) Int. Cl.
*F01D 5/00* (2006.01)
*H02K 41/02* (2006.01)

(52) U.S. Cl. .... 416/23; 416/223 R; 257/414; 310/12.03; 359/212.2

(58) Field of Classification Search ..... 416/23–24, 416/132 R, 223 R, 225, 234, 240–241; 257/414–420; 310/12.03; 359/212.2, 216.1–217.4, 359/220.1–221.1, 223.1–224.2
See application file for complete search history.

(56) References Cited

U.S. PATENT DOCUMENTS

| | | | | |
|---|---|---|---|---|
| 7,302,967 | B2 * | 12/2007 | Maeda et al. | 137/512.1 |
| 7,357,873 | B2 * | 4/2008 | Hong et al. | 216/2 |
| 7,535,068 | B2 * | 5/2009 | Hong et al. | 257/414 |
| 2004/0141288 | A1 * | 7/2004 | Franz et al. | 361/695 |
| 2008/0280231 | A1 * | 11/2008 | Horng et al. | 430/312 |
| 2008/0280387 | A1 * | 11/2008 | Horng et al. | 438/50 |
| 2009/0243427 | A1 * | 10/2009 | Horng et al. | 310/300 |

FOREIGN PATENT DOCUMENTS

| | | |
|---|---|---|
| TW | I275563 | 3/2007 |

* cited by examiner

*Primary Examiner* — Matthew W Such
(74) *Attorney, Agent, or Firm* — Alan Kamrath; Kamrath & Associates PA

(57) ABSTRACT

A self-assembly micro fan includes a body, a plurality of blades and flexible joints, with any one of the blades being connected to the body by one of the flexible joints while each flexible joint is regarded as a pivot to move the blade connected therewith to have an angle relative to a radial direction of the body. Besides, each of the flexible joints has plural link members or at least one link member and extension member to provide variable types of shape of the micro fans, so that the air driving efficiency of the self-assembly micro fan is improved.

16 Claims, 8 Drawing Sheets

SELF-ASSEMBLY MICRO FAN

This is a continuation-in-part application of U.S. patent application Ser. No. 12/068,578 filed on Feb. 8, 2008.

BACKGROUND OF THE INVENTION

1. Field of the Invention

The present invention relates to a fan and, more particularly, to a micro fan realized by micro electromechanical system technology.

2. Description of the Related Art

A conventional self-assembly micro fan is described in Taiwan Patent No. 1275563 entitled "SELF-ASSEMBLY STRUCTURE CONSTRUCTED BY POLYIMIDE FILM," which is a micro fan realized by self-assembly technique of micro electromechanical systems technology. Referring to FIG. 1, the conventional micro fan 9 includes a body 91, a plurality of blades 92, and a plurality of flexible joints 93. The body 91 has a hub 911 positioned at a center of an outer ring 913 and connecting with the outer ring 913 by a plurality of actuators 912. The blades 92 are radially arranged along an outer periphery of the outer ring 913. The plural flexible joints 93 respectively connect between the blades 92 and the outer ring 913.

Now please turn to FIG. 2. The flexible joints 93 of the conventional micro fan 9 realized by self-assembly technique is constructed by polyimide film. In manufacture of the micro fan 9, the flexible joints 93 are performed with a reflow process in an oven and thus bent owing to thermal contraction. Consequently, through the thermal-caused bending, each blade 92 is lifted and pivots on the flexible joint 93 connected therewith and has an angle relative to a radial direction of the body 91, and hence the manufacture of the micro fan 9 is accomplished.

Generally, for any one of the blades 92, because the flexible joint 93 linking the blade 92 and the outer ring 913 is only a squared member while the blade 92 and the outer ring 913 merely connect with two ends of the flexible joint 93 respectively, an area for combination between the blade 92 and the flexible joint 93 is obviously limited, and thus the angle between the blade 92 and the radial direction of the body 91 is also limited. Furthermore, owing to the crude combination between the blade 92 and the flexible joint 93, the blade 92 can only be simply lifted without curvature or an inclined inner edge, and thus the air-driving efficiency of the conventional micro fan 9 is limited too. Hence, there is a need for an improvement over the conventional micro fan 9.

SUMMARY OF THE INVENTION

It is therefore the primary objective of this invention to provide a self-assembly micro fan having a plurality of flexible joints that can be formed in various shapes to obtain various types of blades with curvature or inclined inner edges, so as to improve air-driving efficiency thereof.

A self-assembly micro fan according to one aspect of the present invention includes a body having a hub connecting to an outer ring through plural actuators, plural blades radially arranged along an outer periphery of the outer ring of the body with each blade having a first edge and a second edge, and plural flexible joints respectively linking the blades and the outer ring, wherein each flexible joint has a link member and at least one extension member, the link member connects between the first edge of one of the blades and the outer ring, and the at least one extension member fixedly attaches on a surface of the blade, connects with the link member by one end, and extends to the second edge of the blade by another end. Accordingly, after the flexible joints are performed with a reflow process and bent for thermal contraction, enlarged angles between the blades and the radial direction of the body are provided.

Another self-assembly micro fan according to another aspect of the present invention includes a body having a hub connecting to an outer ring through plural actuators, plural blades radially arranged along an outer periphery of the outer ring of the body with each blade having a first edge and a second edge, and plural flexible joints respectively linking the blades and the outer ring, wherein each flexible joint has two link members with a gap between, one of the two link members crosses a first distance between the first edge of the blade and the outer ring, the other one of the two link members crosses a second distance between the first edge of the blade and the outer ring, and the first distance is larger than the second distance. Accordingly, after the flexible joints are performed with the reflow process and bent for thermal contraction, blades with inclined inner edges and enlarged angles between the blades and the radial direction of the body are provided.

Another self-assembly micro fan according to still another aspect of the present invention includes a body having a hub connecting to an outer ring through plural actuators, plural first blades radially arranged along an outer periphery of the outer ring of the body with each first blade having a first edge and a second edge, plural second blades radially and respectively aligning with the first blades with each second blade having a first edge and a second edge while the first edge of any one of the second blade faces the second edge of the first blade aligned with the second blade, plural first flexible joints respectively linking the first blades and the outer ring, and plural second flexible joints respectively linking the first blades and second blades, wherein each second flexible joint has at least one link member and at least one extension member, the at least one link member connects between the second edge of one of the first blades and the first edge of the second blade aligning with the first blade, and the at least one extension member fixedly attaches on a surface of the second blade, connects with the at least one link member by one end, and extends to the second edge of the second blade by another end. Accordingly, after the flexible joints are performed with the reflow process and bent for thermal contraction, different angles between the first and second blades and the radial direction of the body are provided.

In an example, a number of the at least one extension member is one, and the said another end of the extension member extends to a corner at the second edge of the blade. Accordingly, after the flexible joints are performed with the reflow process and bent for thermal contraction, curved blades especially in curved shapes at the corners are provided.

In an example, a number of the at least one extension member is two, the said another end of one of the extension member extends to a corner at the second edge of the blade, and the said another end of the other one of the extension member extends to a middle point between the first and second edges of the blade. Accordingly, after the flexible joints are performed with the reflow process and bent for thermal contraction, the extension member with the end extending to the middle point can enhance a force lifting the blade and further increase the angle between the blade and the radial direction of the body.

In an example, the extension member with the end extending to the middle point between the first and second edges extends in a direction toward another corner at the second edge of the blade. Accordingly, the said extension member can enhance the efficiency of manufacture of the self-assembly micro fan when the flexible joints are performed with the reflow process and bent for thermal contraction, Further scope of the applicability of the present invention will become apparent from the detailed description given hereinafter. However, it should be understood that the detailed description and specific examples, while indicating preferable embodiments of the invention, are given by way of illustration only, since various will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
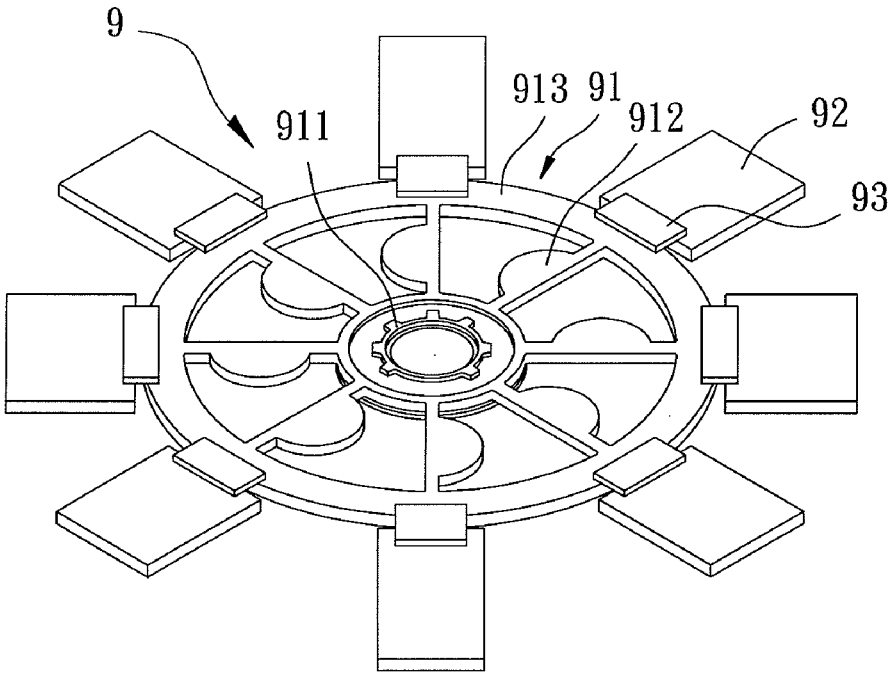
FIG. 1 PRIOR ART
FIG. 1 is an exploded perspective view illustrating a conventional self-assembly micro fan before a reflow process is performed.
Figure 2:
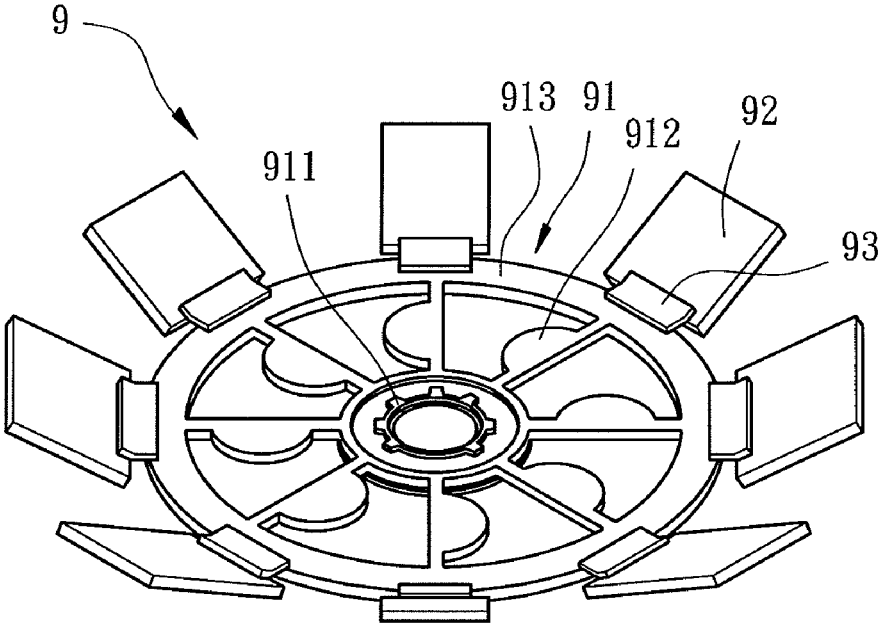
FIG. 2 PRIOR ART
FIG. 2 is an exploded perspective view illustrating a conventional self-assembly micro fan after the reflow process is performed.
Figure 3:
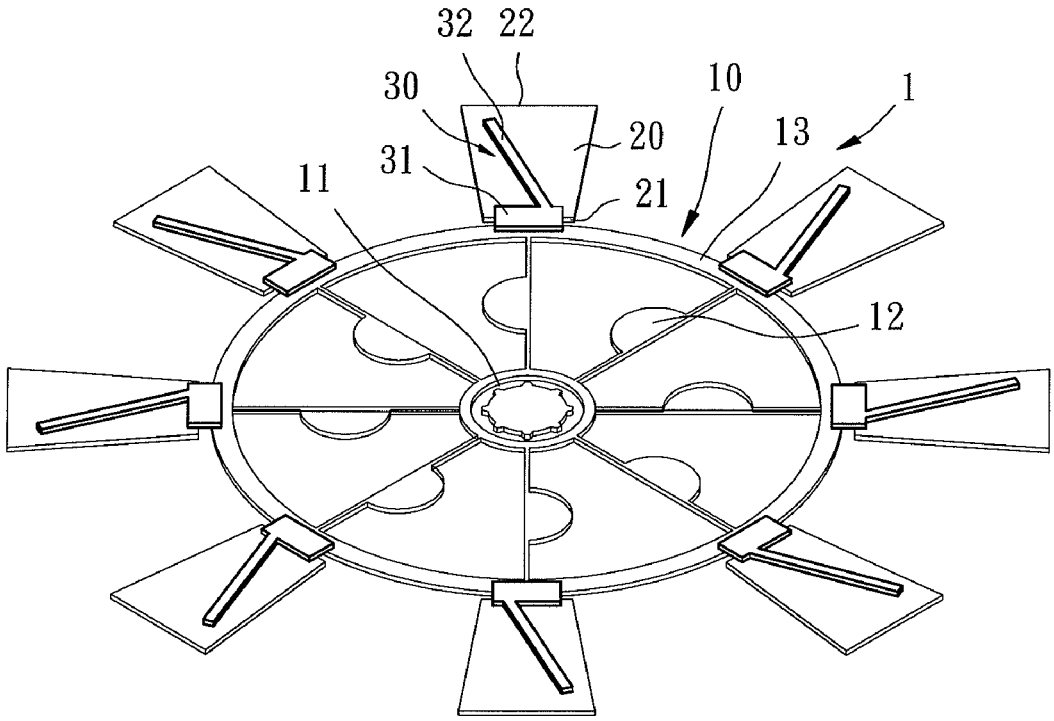
FIG. 3 is an exploded perspective view illustrating a first embodiment of a self-assembly micro fan before a reflow process is performed.

In the various figures of the drawings, the same numerals designate the same or similar parts. Furthermore, when the terms "first", "second", "third", "fourth", "fifth", "sixth", "seventh", "inner", "outer" and similar terms are used hereinafter, it should be understood that these terms are reference only to the structure shown in the drawings as it would appear to a person viewing the drawings and are utilized only to facilitate describing the invention.

DETAILED DESCRIPTION OF THE INVENTION

Figure 13:
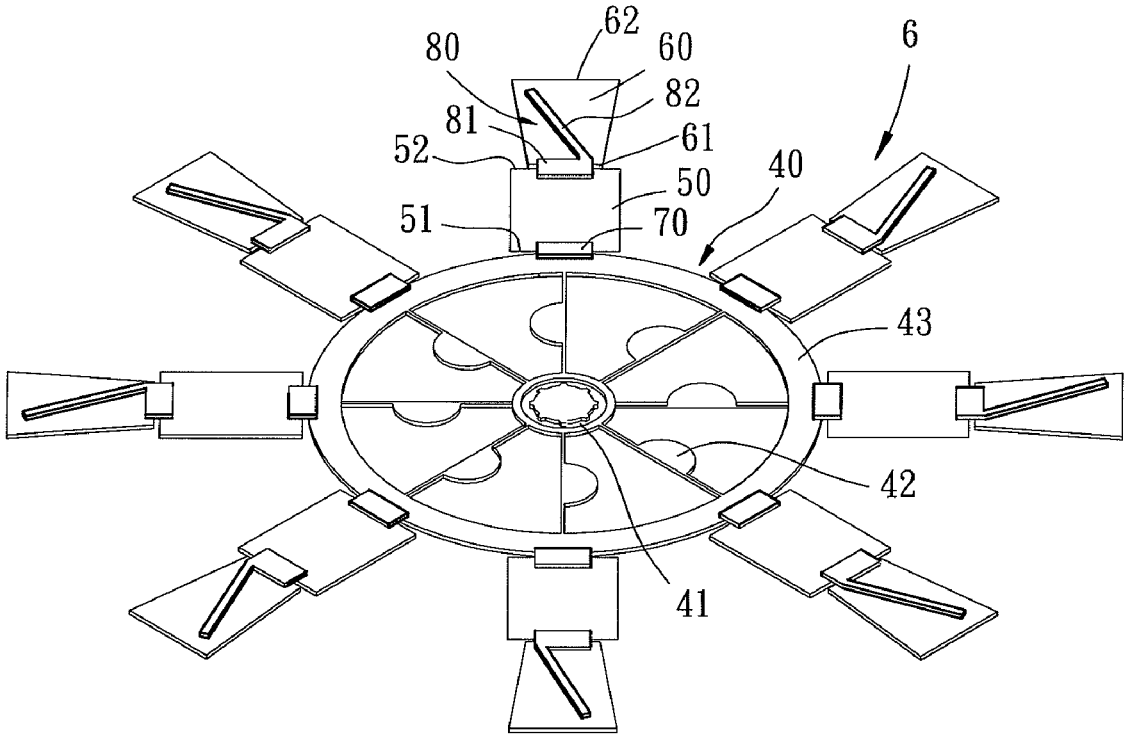
FIG. 13 is an exploded perspective view illustrating a sixth embodiment of a self-assembly micro fan before a reflow process is performed.
Figure 15:
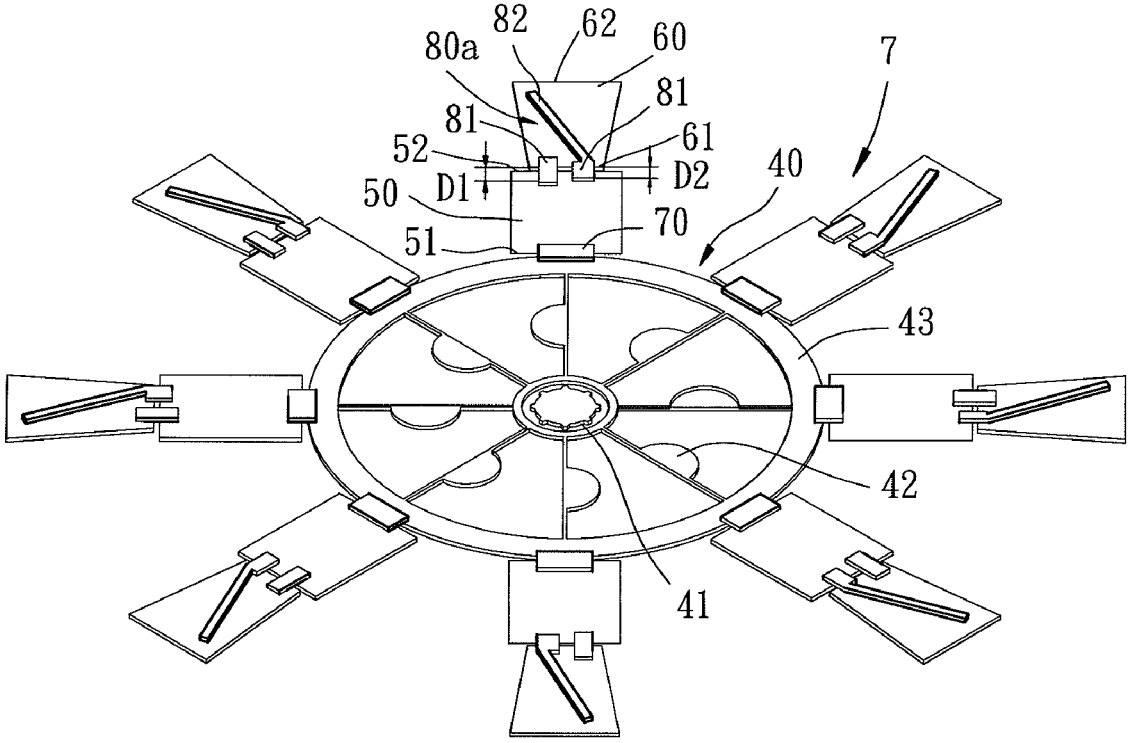
FIG. 15 is an exploded perspective view illustrating a seventh embodiment of a self-assembly micro fan before a reflow process is performed.

Referring to FIGS. 3, 5, 7, 9, 11, the main idea of the self-assembly micro fan of the present invention is to provide a self-assembly micro fan with the following features. The self-assembly micro fan includes a body 10, a plurality of blades 20 and a plurality of flexible joints 30, 30*a*, 30*b*, 30*c*, or 30*d*, with the blades 20 being connected to the body 10 by the flexible joints 30, 30*a*, 30*b*, 30*c*, or 30*d* respectively, while each flexible joint 30, 30*a*, 30*b*, 30*c*, or 30*d* is regarded as a pivot to move the blade 20 connected therewith to have an angle relative to a radial direction of the body 10. The self-assembly micro fan of the present invention is characterized in that each of the flexible joints 30, 30*a*, 30*b*, 30*c*, or 30*d* has plural link members 31 or at least one link member 31 and at least one extension member 32 to form the blades 20 into curved shapes and/or with inclined inner edges. Besides, the above design of the flexible joints 30, 30*a*, 30*b*, 30*c*, or 30*d* also increases the angle between the blade 20 and the radial direction and thus improves the air driving efficiency of the self-assembly micro fan. Moreover, referring to FIGS. 13 and 15, a plurality of second flexible joints 80, 80*a* designed in the same idea of those shown in FIGS. 3, 5, 7, 9, 11 can also be applied in a combination between two blades 50, 60. Details about embodiments of the self-assembly micro fan of the present invention are further illustrated as the following.

Turning to the FIG. 3 again, a first embodiment of the self-assembly micro fan of the present invention, which is designated numeral "1", including the body 10, blades 20 and flexible joints 30 is shown. The body 10 has a hub 11, a plurality of actuators 12, and an outer ring 13, with the hub 11 connecting to the outer ring 13 through the actuators 12, that is, each actuator 12 connecting between the hub 11 and the outer ring 13, wherein any adjacent two of the actuators 12 are spaced apart and the distances between the actuators 12 are preferably identical. The blades 20 are radially arranged along an outer periphery of the outer ring 13, with each blade 20 having a first edge 21 facing and being apart from the outer ring 13 and a second edge 22 as a free end. The flexible joints 30 are made of polymeric material that will contract and be bent after being heated, such as photosensitive polyimide. The flexible joints 30 respectively link the blades 20 and the outer ring 13; and, for each of the flexible joints 30 in this embodiment, numbers of the at least one link member 31 and extension member 32 are one. Two ends of the link member 31 respectively connect with the first edge 21 of one of the blades 20 and the outer ring 13, and the extension member 32 fixedly attaches on a surface of the blade 20 between the first and second edges 21, 22. Besides, specifically, one end of the extension member 32 connects with the link member 31, and another end of the extension member 32 extends to a corner at the second edge 22 of the blade 20.

Figure 4:
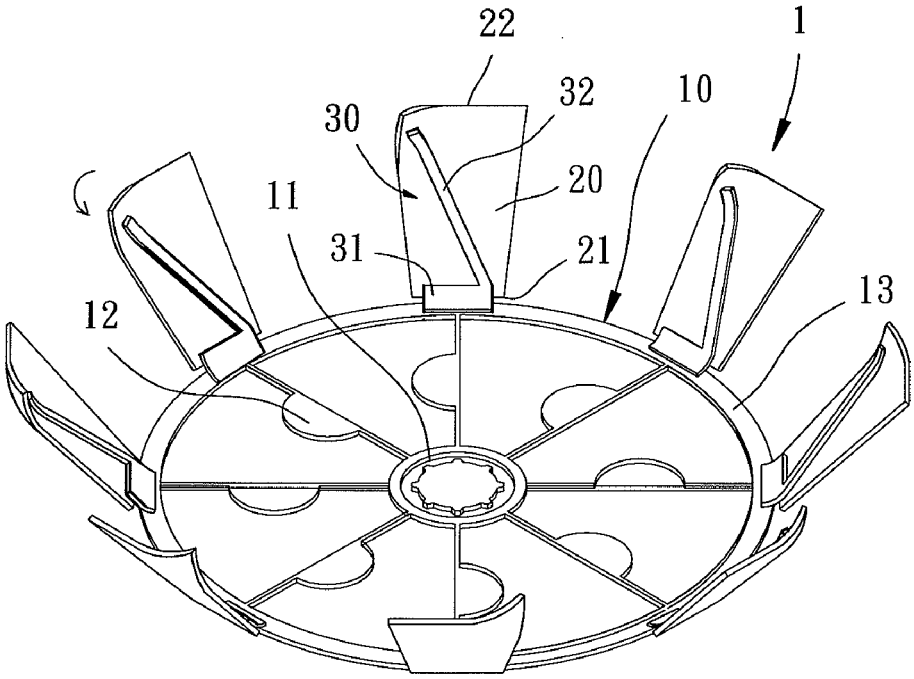
FIG. 4 is an exploded perspective view illustrating a first embodiment of the self-assembly micro fan after the reflow process is performed.
Figure 5:
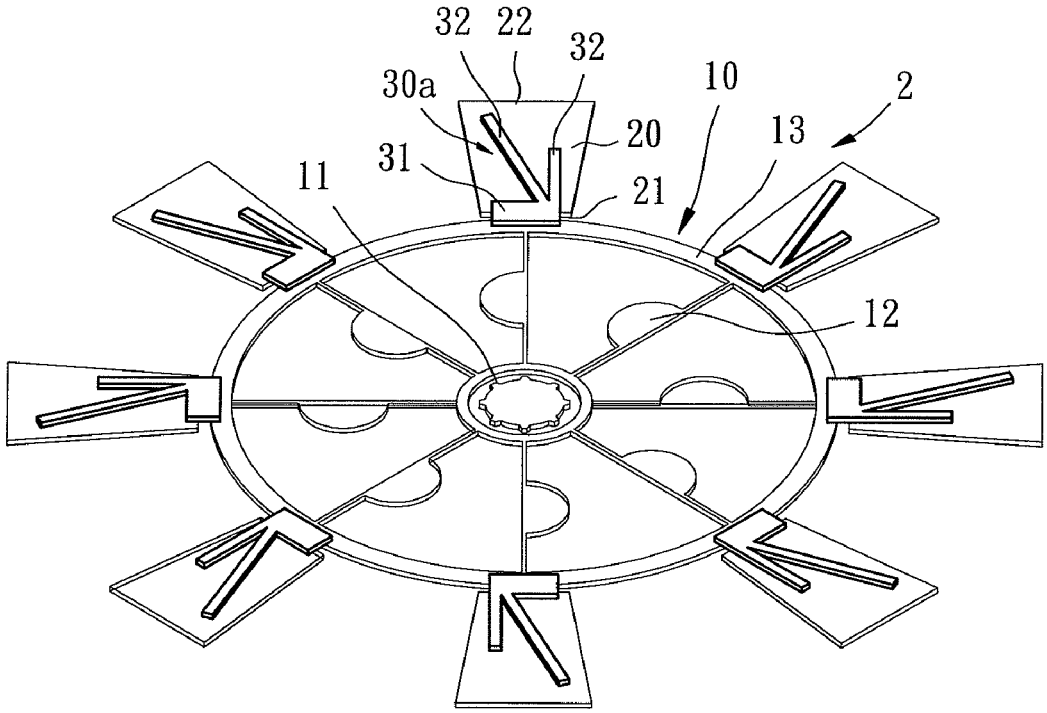
FIG. 5 is an exploded perspective view illustrating a second embodiment of a self-assembly micro fan before a reflow process is performed.

Referring to FIG. 4 now, in manufacture of the micro fan 1, the flexible joints 30 are performed with a reflow process through an oven and thus bent owing to thermal contraction. While the flexible joints 30 are heated and contracting, the link members 31 are bent and the blades 20 are lifted and respectively pivot on the link members 31 to form the angles between the blades 20 and the radial direction of the body 10. Also, while the flexible joints 30 are heated and contracting, the extension members 32 are bent to effectively assist the pivoting movements of the blades 20 and thus enlarge the angles between the blades 20 and the radial direction of the body 10. Moreover, because the extension member 32 fixedly attaches on the surface of the blade 20 and extends from the first edge 21 to the corner of the second edge 22, the blade 20 is therefore bent into a curved shape as shown in FIG. 4, especially at the corner. Consequently, with the above-mentioned design of the flexible joints 30, the blades 20 can be lifted with the enlarged angle relative to the radial direction of the body 10 and formed into curved shapes especially at the corners thereof.

Turning to the FIG. 5 again, a second embodiment of the self-assembly micro fan of the present invention, which is designated numeral "2", including the body 10, blades 20 and flexible joints 30*a* is shown. The structures of and relationship between the body 10 and blades 20 are substantially identical to those of the first embodiment, but the number of the at least one link member 31 is one and that of the at least one extension member 32 is two for each of the flexible joints 30*a* in this embodiment. The link member 31 still respectively connects between the first edge 21 of one of the blades 20 and the outer ring 13 with two ends thereof, and both extension members 32 also attach on the surface of the blade 20 between the first and second edges 21, 22. Furthermore, each of the two extension members 32 connects with the link member 31 by one end, another end of one of the two extension members 32 extends to a corner at the second edge 22 of the blade 20, and another end of the other one of the two extension members 32 extends to a middle point between the first and second edges 21, 22. Preferably, the extension member 32 with the end extending to the middle point between the first and second edges 21, 22 extends in a direction toward another corner at the second edge 22 of the blade 20.

Figure 6:
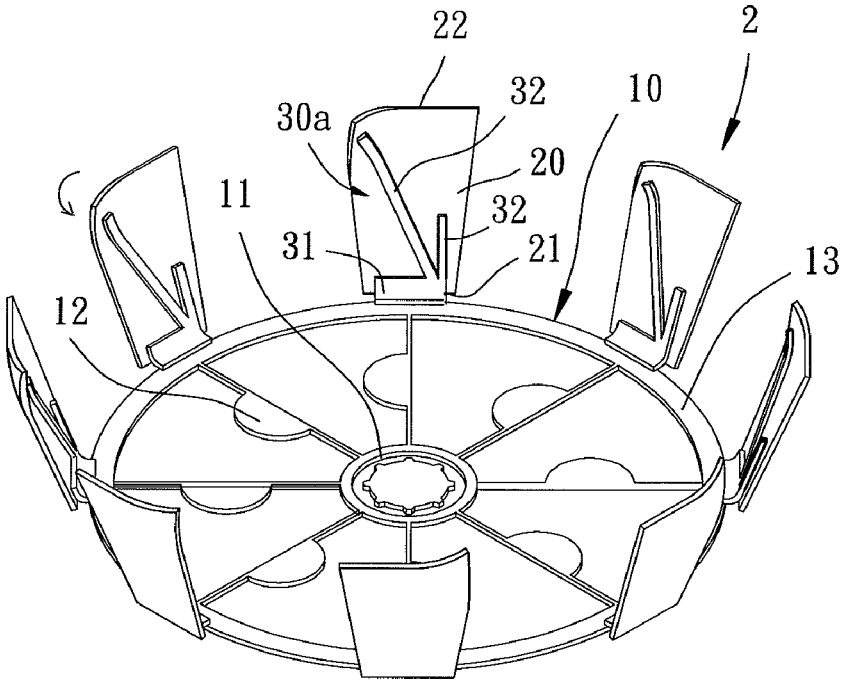
FIG. 6 is an exploded perspective view illustrating a second embodiment of the self-assembly micro fan after the reflow process is performed.
Figure 7:
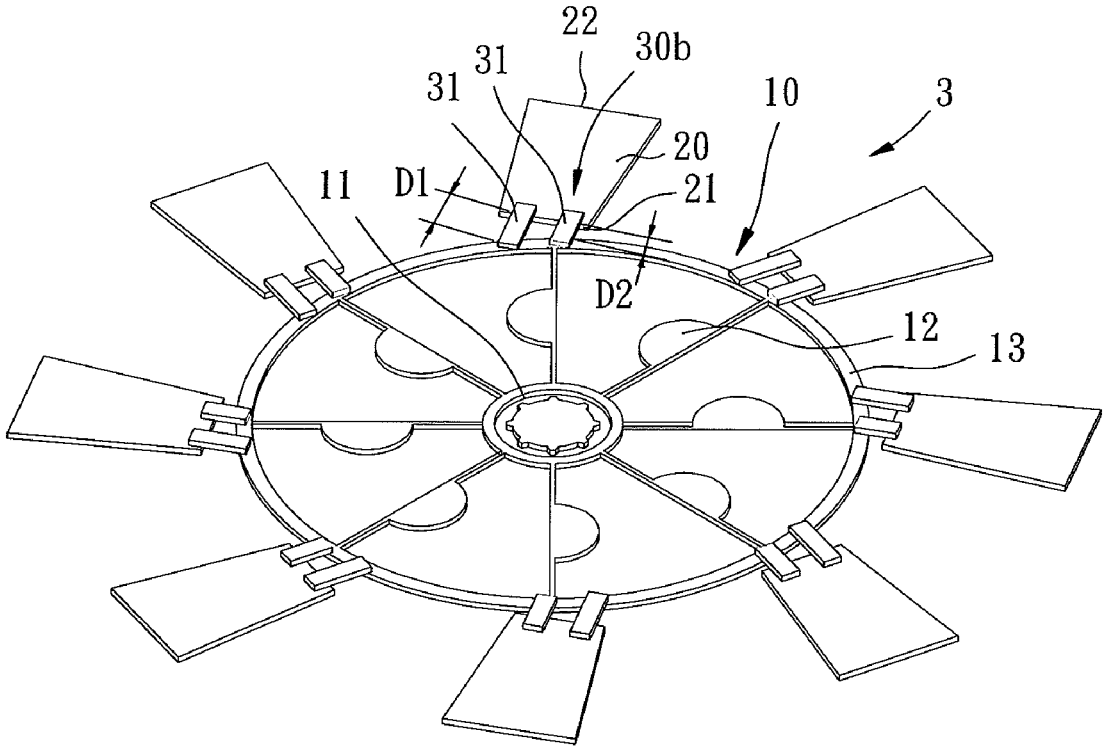
FIG. 7 is an exploded perspective view illustrating a third embodiment of a self-assembly micro fan before a reflow process is performed.

Referring to FIG. 6, in manufacture of the self-assembly micro fan 2, the flexible joints 30*a* are also bent for thermal contraction when being performed with the reflow process. Besides, while the flexible joints 30*a* are heated and contracting, the extension member 32 with the end extending to the middle point between the first and second edges 21, 22 can further enhance a force lifting the blade 20, and thus the angle between the blade 20 and the radial direction of the body 10 can be further increased.

Turning to the FIG. 7 again, a third embodiment of the self-assembly micro fan of the present invention, which is designated numeral "3," including the body 10, blades 20 and flexible joints 30*b* is shown, with the structures of and relationship between the body 10 and blades 20 being substantially identical to those of the first embodiment. Two link members 31 without any extension member 32 are used in the flexible joints 30*b* to link the first edge 21 of one of the blades 20 and the outer ring 13. For each flexible joint 30*b*, it is characterized in that a gap is formed between the two link members 31, one of the two link members 31 crosses a first distance D1 between the first edge 21 and the outer ring 13, and the other one of the two link members 31 crosses a second distance D2 between the first edge 21 and the outer ring 13. Furthermore, the first distance D1 is larger than the second distance D2.

Figure 8:
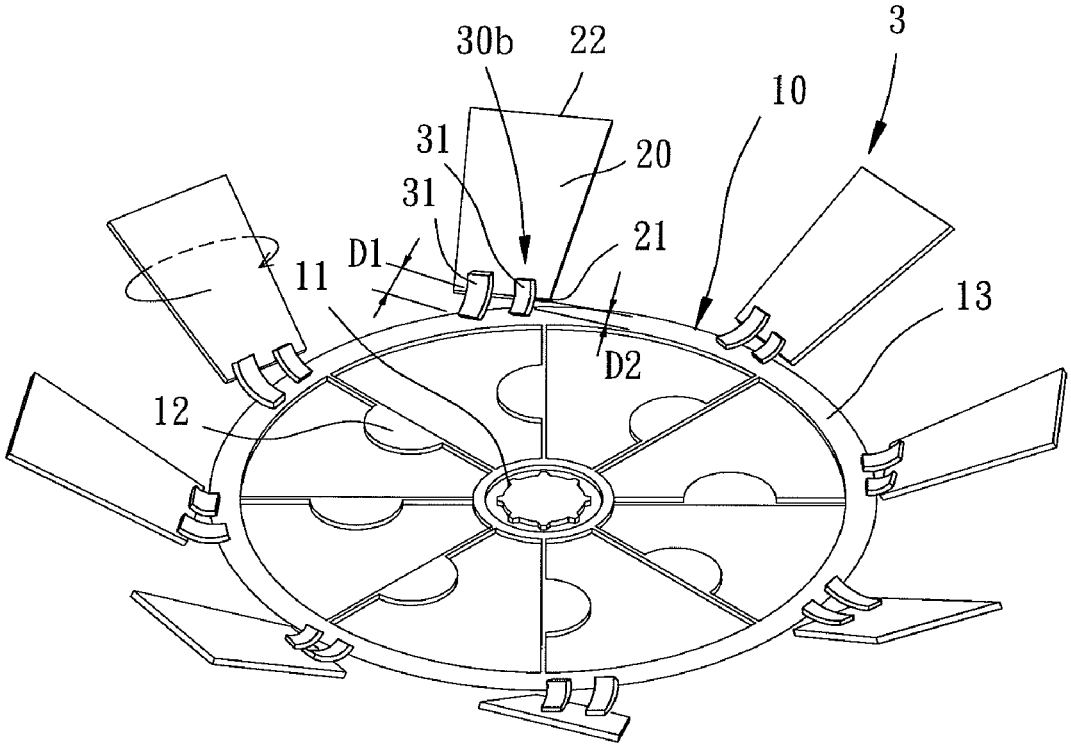
FIG. 8 is an exploded perspective view illustrating a third embodiment of the self-assembly micro fan after the reflow process is performed.
Figure 9:
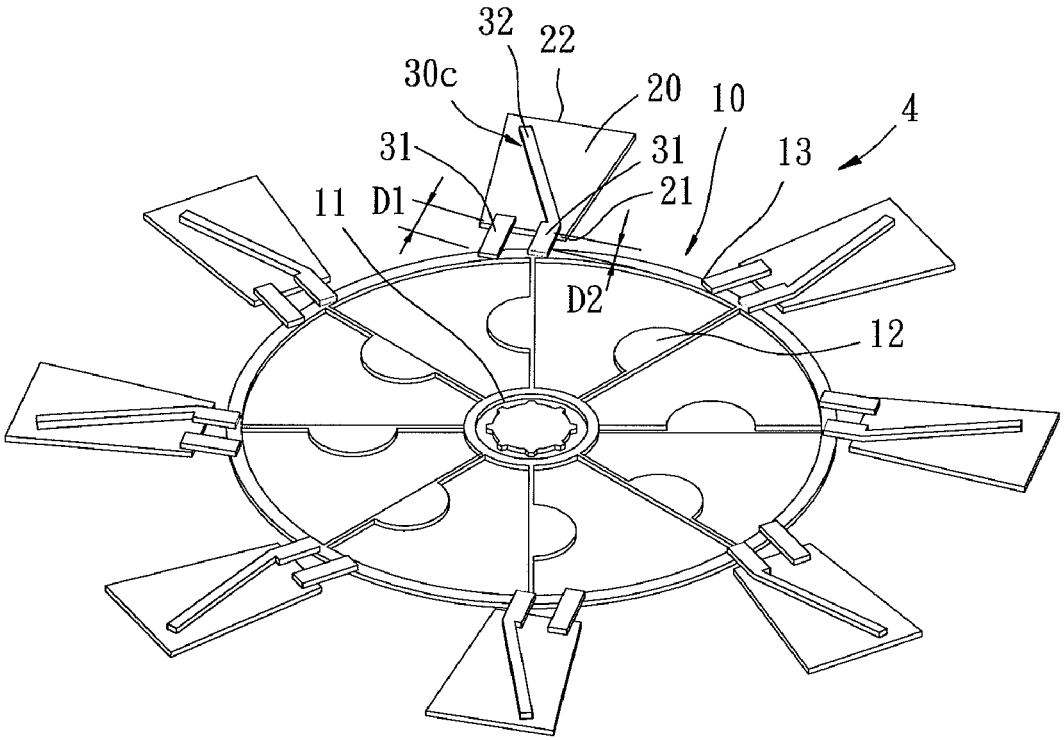
FIG. 9 is an exploded perspective view illustrating a fourth embodiment of a self-assembly micro fan before a reflow process is performed.

Referring to FIG. 8, in manufacture of the self-assembly micro fan 3, the flexible joints 30*b* are also bent for thermal contraction when being performed with the reflow process. While the flexible joints 30*b* are heated and contracting, each blade 20 is lifted by the two link members 31 of the flexible joint 30*b* connecting therewith, with the two link members 31 being pivots for the blade 20 to move to form the angle between the blade 20 and the radial direction of the body 10. Besides, owing to the difference between the first and second distances D1, D2, that is, the first distance D1 being larger than the second distance D2, each of the first edges 21, namely, radially inner edges of the blades 20 is inclined as shown in FIG. 8.

Now turning to the FIGS. 9 and 11 again, fourth and fifth embodiments of the self-assembly micro fan of the present invention are shown, which are designated numerals "4" and "5" respectively and each of which includes the body 10, blades 20 and flexible joints 30*c* or 30*d*, with the structures of and relationship between the body 10 and blades 20 being substantially identical to those of the first embodiment. For each of the flexible joints 30*c*, 30*d*, the number of the at least one link member 31 is two; however, there is only one extension member 32 used in the flexible joint 30*c* while two extension members 32 are used in the flexible joint 30*d*. The two link members 31 of each flexible joint 30*c*, 30*d* also respectively cross the first and second distances D1, D2 between the first edge 21 and the outer ring 13, which are substantially similar to those of the third embodiment. Furthermore, regarding to each flexible joint 30*c* of the fourth embodiment, the extension member 32 connects with one of the two link members 31 by one end and extends to a corner at the second edge 22 of the blade 20 by another end. On the other hand, regarding to each flexible joint 30*d* of the fifth embodiment, each of the two extension members 32 connects with one of the link member 31 by one end, another end of one of the two extension members 32 extends to a corner at the second edge 22 of the blade 20, and another end of the other one of the two extension members 32 extends to a middle point between the first and second edges 21, 22, wherein the extension member 32 with the end extending to the middle point between the first and second edges 21, 22 preferably extends in a direction toward another corner at the second edge 22 of the blade 20. Moreover, for each of the flexible joints 30*c*, 30*d*, the link member 31 connecting with the extension member 32 is preferably the one crossing the second distance D2.

Figure 10:
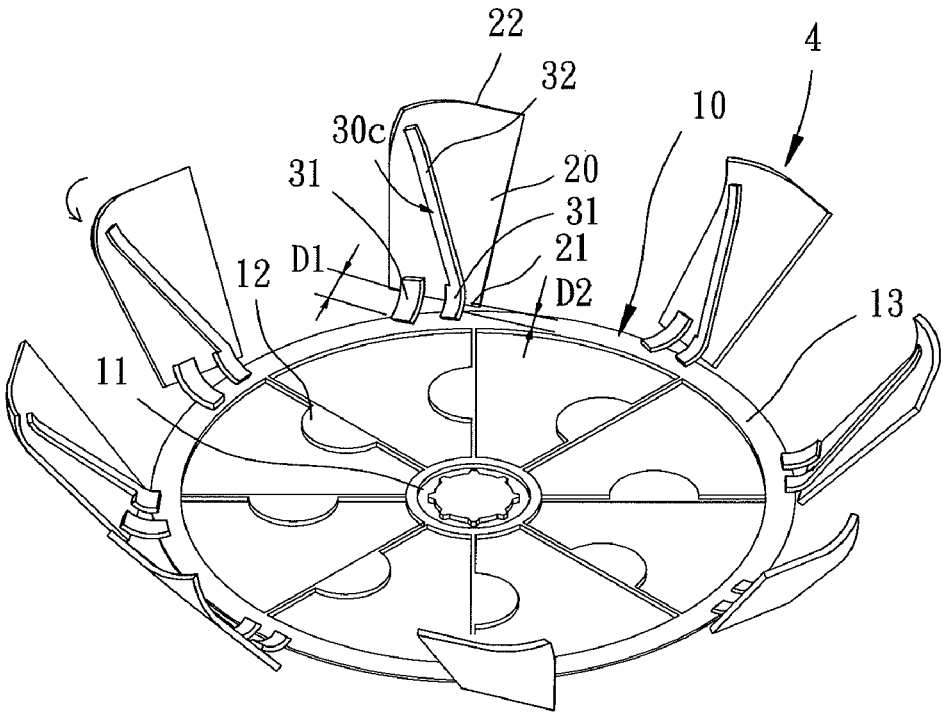
FIG. 10 is an exploded perspective view illustrating a fourth embodiment of the self-assembly micro fan after the reflow process is performed.
Figure 11:
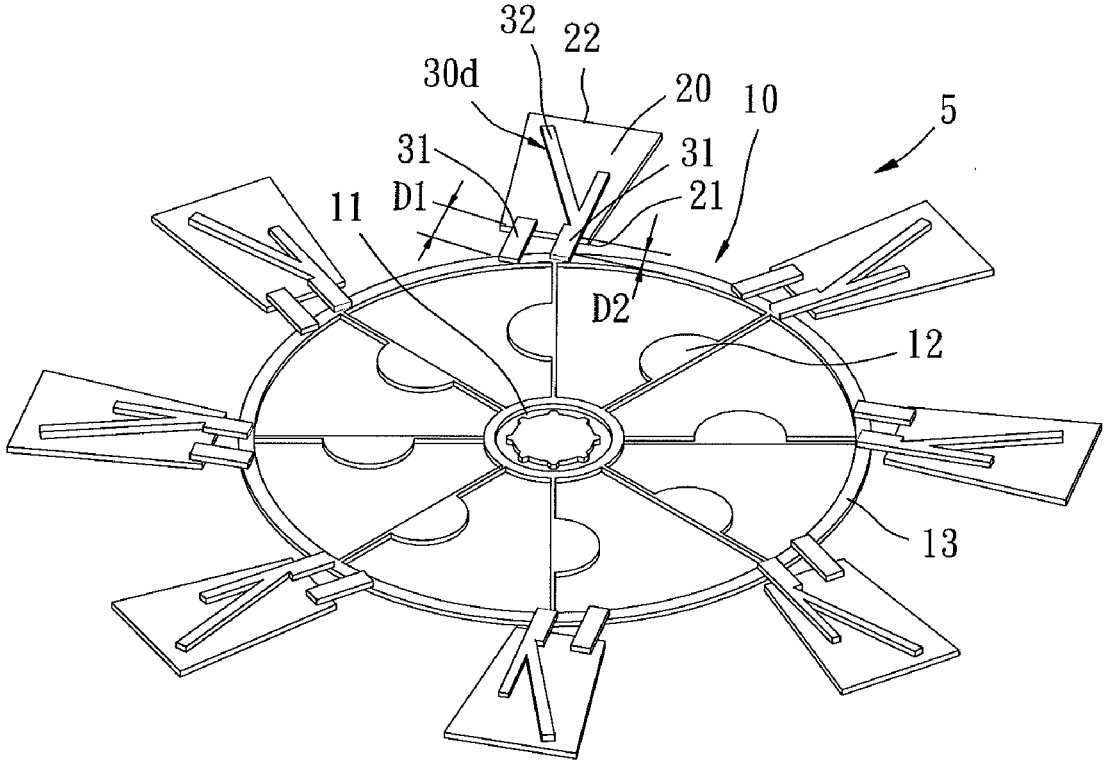
FIG. 11 is an exploded perspective view illustrating a fifth embodiment of a self-assembly micro fan before a reflow process is performed.
Figure 12:
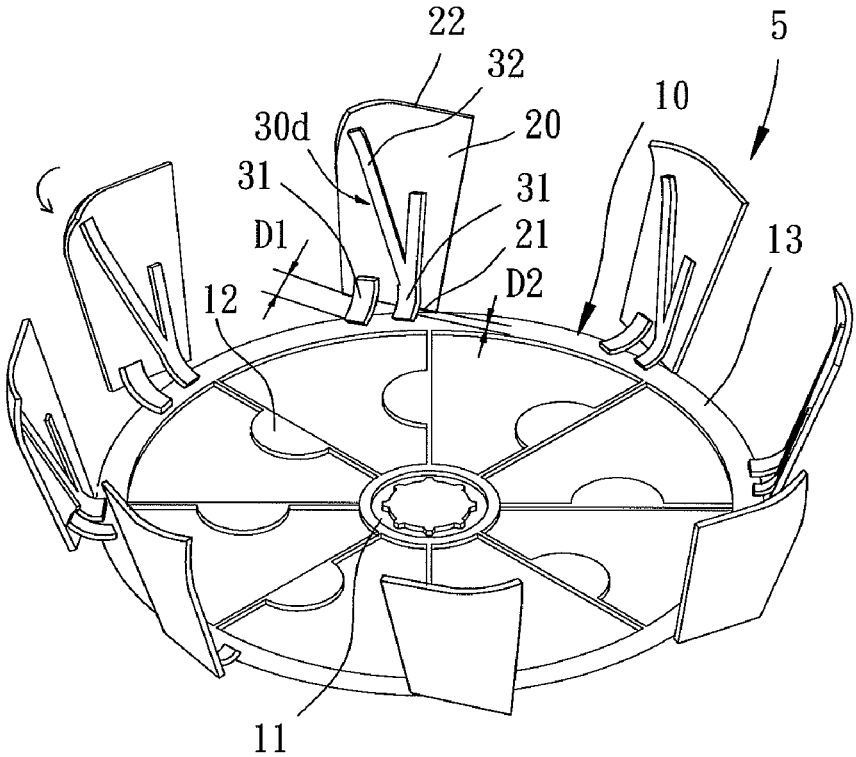
FIG. 12 is an exploded perspective view illustrating a fifth embodiment of the self-assembly micro fan after the reflow process is performed.

Referring to FIG. 10, in manufacture of the micro fan 4, the flexible joints 30*c* are bent for thermal contraction when being performed with the reflow process. Owing to the difference between the first and second distances D1, D2, the two link members 31 not only lift the blade 20 connecting therewith to form the angle between the blade 20 and the radial direction of the body 10 but also have the first edge 21 to be an inclined inner edge of the blade 20. Besides, the blade 20 is bent into a curved shape, especially at the corner, because the extension member 32 fixedly attaches on the surface of the blade 20 and extends from the first edge 21 to the corner of the second edge 22. And, referring to FIG. 12, in manufacture of the micro fan 5, the flexible joints 30*d* are bent for thermal contraction when being performed with the reflow process. In comparison with the flexible joints 30*c* of the fourth embodiment, each flexible joints 30*d* not only provides the curved blade 20 and the inclined first edge 21 by the two link members 31 and the extension member 32 extending from the first edge 21 to the corner of the second edge 22, but also enhances the force lifting the blade 20 by the extension member 32 extending to the middle point between the first and second edges 21, 22.

Figure 14:
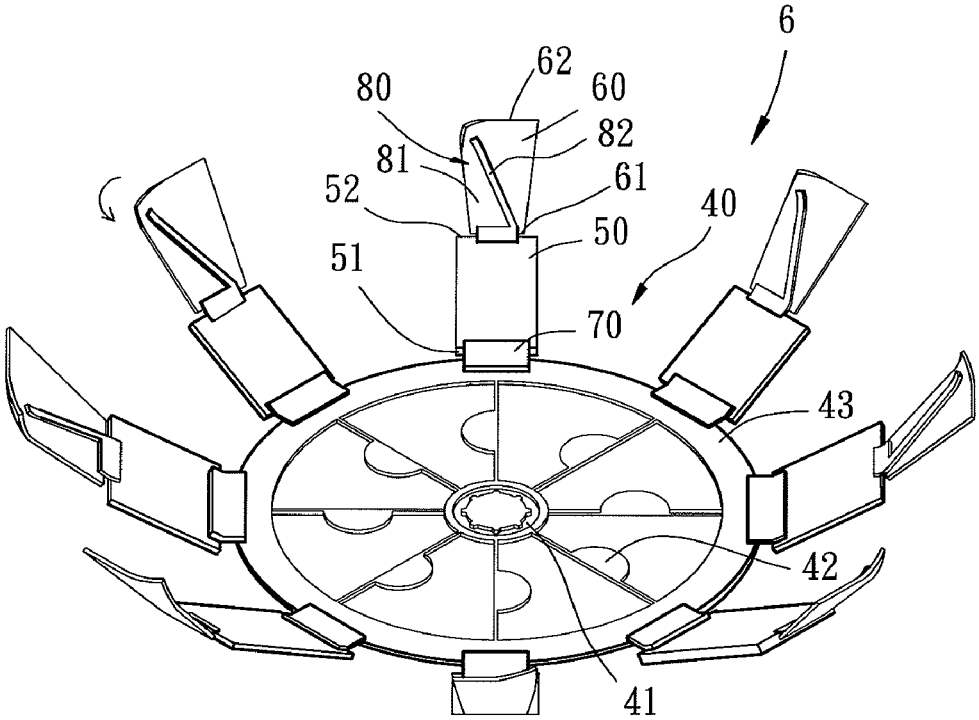
FIG. 14 is an exploded perspective view illustrating a sixth embodiment of the self-assembly micro fan after the reflow process is performed.

Now turning to the FIG. 13 again, a sixth embodiment of the self-assembly micro fan of the present invention is shown and designated numerals "6," and includes the body 40, the first and second blades 50, 60, a plurality of first flexible joints 70 and the second flexible joints 80. The body 40 has a hub 41 connecting to an outer ring 43 through a plurality of actuators 42, with the first blades 50 radially arranged along an outer periphery of the outer ring 43 and each first blade 50 having a first edge 51 and a second edge 52 while the first edge 51 faces and being apart from the outer ring 43. The second blades 60 radially and respectively align with the first blades 50, with each second blade 60 having a first edge 61 facing the second edge 52 of one of the first blade 50 aligned with the second blade 60 and a second edge 62 as a free end. Each first flexible joint 70 has two ends respectively connecting with the first edge 51 of one of the first blades 50 and the outer ring 43. The second flexible joints 80 respectively link the first blades 50 and second blades 60, and each second flexible joint 80 includes a link member 81 and an extension member 82. The link member 81 connects between the second edge 52 of one of the first blades 50 and the first edge 61 of one of the second blades 60, while the extension member 82 fixedly attaches on a surface of the second blade 60, with one end of the extension member 82 connecting with the link member 81 and another end of the extension member 82 extending to a corner at the second edge 62 of the second blade 60. Regarding to the FIG. 14, since the outer ring 43, first blade 50 and second blade 60 are radially and serially connected by the first flexible joint 70 and the second flexible joint 80, after the flexible joints 70, 80 are performed with the reflow process, the first blade 50 is lifted by the first flexible joints 70, and the second blade 60 is further lifted by the second flexible joints 80. Therefore, the first blade 50 and second blade 60 have different angles relative to a radial direction of the body 40, while the second blade 60 further has a curved shape owing to the extension member 82 extending from the first edge 61 to the corner of the second edge 62.

Figure 16:
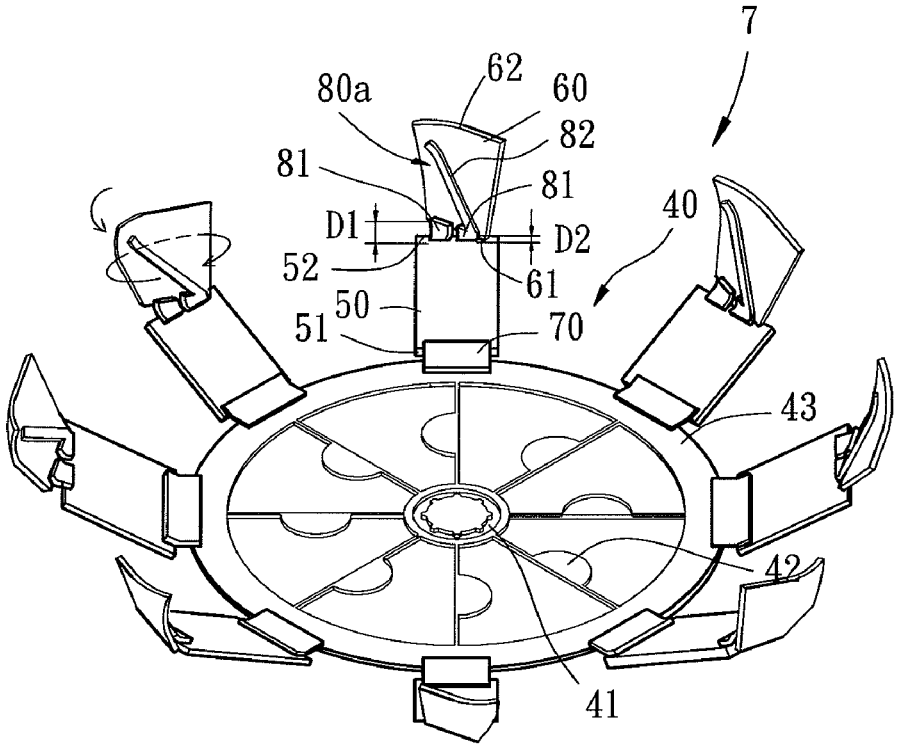
FIG. 16 is an exploded perspective view illustrating a seventh embodiment of the self-assembly micro fan after the reflow process is performed.

Now turning to the FIG. 15 again, a seventh embodiment of the self-assembly micro fan of the present invention, which is designated numerals "7," including the body 40, the first and second blades 50, 60, a plurality of first flexible joints 70 and the second flexible joints 80*a* is shown, with the structures of and relationship between the body 40, first and second blades 50, 60 and first flexible joints 70 being substantially identical to those of the sixth embodiment. Furthermore, each of the second flexible joints 80*a* includes two link members 81 and an extension member 82. The two link members 81 respectively cross a first distance D1 and a second distance D2 between the first blade 50 and the second blade 60, with a gap between the two link members 81 and the first distance D1 being larger than the second distance D2. The extension member 82 also fixedly attaches on a surface of the second blade 60, with one end of the extension member 82 connecting with one of the link member 81 and another end of the extension member 82 extending to a corner at the second edge 62 of the second blade 60. Accordingly, referring to FIG. 16, in comparison with the self-assembly micro fan 6 of the sixth embodiment, in addition to the different angles of the first and second blades 50, 60 relative to the radial direction of the body 40 and the curved shapes of the second blades 60 formed by the extension members 82, each of the first edges 61 of the second blade 60 is inclined after the flexible joints 70, 80*a* are performed with the reflow process. Thus, another type of shape of the self-assembly micro fan of the present invention is provided.

Please be noted that the second flexible joints 80, 80*a* in the sixth and seventh embodiments can also be in the form similar to that of the flexible joints 30*a*, 30*d* in the second and fifth embodiments to enhance forces lifting the second blades 60. As has been discussed above, various design and arrangement of the shapes of the flexible joints 30, 30*a*, 30*b*, 30*c*, 30*d*, 80, 80*a* can provide various kinds of self-assembly micro fan with curved blades 20, 60 and/or inclined first edges 21, 61 and enlarged angles between the radial direction of the body 10, 40 and the blades 20, 50, 60. Consequently, through the blades 20, 50, 60 with curvature or inclined inner edges, improved air driving efficiency is resulted by the self-assembly micro fans 1-7 of the present invention.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A self-assembly micro fan, comprising:

a body having a hub, an outer ring, and a plurality of actuators, with the hub connecting to the outer ring through the actuators;

plural blades radially arranged along an outer periphery of the outer ring of the body, with each blade having a first edge and a second edge; and plural flexible joints respectively linking the blades and the outer ring, wherein each flexible joint has a link member and at least one extension member, the link member connects between the first edge of one of the blades and the outer ring, and the at least one extension member fixedly attaches on a surface of the blade, connects with the link member by one end, and extends to the second edge of the blade by another end.

2. The self-assembly micro fan as defined in claim 1, wherein a number of the at least one extension member is one, and the said another end of the extension member extends to a corner at the second edge of the blade.

3. The self-assembly micro fan as defined in claim 1, wherein a number of the at least one extension member is two, the said another end of one of the extension members extends to a corner at the second edge of the blade, and the said another end of the other one of the extension members extends to a middle point between the first and second edges of the blade.

4. The self-assembly micro fan as defined in claim 3, wherein the extension member with the end extending to the middle point between the first and second edges extends in a direction toward another corner at the second edge of the blade.

5. A self-assembly micro fan, comprising:

a body having a hub, an outer ring, and a plurality of actuators, with the hub connecting to the outer ring through the actuators;

plural blades radially arranged along an outer periphery of the outer ring of the body, with each blade having a first edge and a second edge; and plural flexible joints respectively linking the blades and the outer ring, wherein each flexible joint has two link members with a gap between, one of the two link members crosses a first distance between the first edge of the blade and the outer ring, the other one of the two link members crosses a second distance between the first edge of the blade and the outer ring, and the first distance is larger than the second distance.

6. The self-assembly micro fan as defined in claim 5, wherein each flexible joint further has an extension member fixedly attaching on a surface of the blade, connecting with one of the link members by one end, and extending to the second edge of the blade by another end.

7. The self-assembly micro fan as defined in claim 5, wherein each flexible joint further has two extension members fixedly attaching on a surface of the blade, and each of the two extension members connects with one of the link members by one end, with another end of one of the two extension members extending to a corner at the second edge of the blade, and another end of the other one of the two extension members extending to a middle point between the first and second edges of the blade.

8. The self-assembly micro fan as defined in claim 7, wherein the extension member with the end extending to the middle point between the first and second edges extends in a direction toward another corner at the second edge of the blade.

9. A self-assembly micro fan, comprising:

a body having a hub, an outer ring, and a plurality of actuators, with the hub connecting to the outer ring through the actuators;

plural first blades radially arranged along an outer periphery of the outer ring of the body, with each first blade having a first edge and a second edge;

plural second blades radially and respectively aligning with the first blades, with each second blade having a first edge and a second edge while the first edge of any one of the second blade faces the second edge of the first blade aligned with the second blade;

plural first flexible joints respectively linking the first blades and the outer ring; and plural second flexible joints respectively linking the first blades and second blades, wherein each second flexible joint has at least one link member and at least one extension member, the at least one link member connects between the second edge of one of the first blades and the first edge of the second blade aligning with the first blade, and the at least one extension member fixedly attaches on a surface of the second blade, connects with the at least one link member by one end, and extends to the second edge of the second blade by another end.

10. The self-assembly micro fan as defined in claim 9, wherein a number of the at least one extension member is one, and the said another end of the extension member extends to a corner at the second edge of the second blade.

11. The self-assembly micro fan as defined in claim 9, wherein a number of the at least one extension member is two, the said another end of one of the two extension members extends to a corner at the second edge of the second blade, and the said another end of the other one of the two extension members extends to a middle point between the first and second edges of the second blade.

12. The self-assembly micro fan as defined in claim 11, wherein the extension member with the end extending to the middle point between the first and second edges of the second blade extends in a direction toward another corner at the second edge of the second blade.

13. The self-assembly micro fan as defined in claim 9, wherein a number of the at least one link member is two, a gap is between the two link members, the two link members respectively cross a first distance and a second distance between the second edge of the first blade and the first edge of the second blade, and the first distance is larger than the second distance.

14. The self-assembly micro fan as defined in claim 13, wherein a number of the at least one extension member is one, and the said another end of the extension member extends to a corner at the second edge of the second blade.

15. The self-assembly micro fan as defined in claim 13, wherein a number of the at least one extension member is two, the said another end of one of the two extension members extends to a corner at the second edge of the second blade, and the said another end of the other one of the two extension members extends to a middle point between the first and second edges of the second blade.

16. The self-assembly micro fan as defined in claim 15, wherein the extension member with the end extending to the middle point between the first and second edges of the second blade extends in a direction toward another corner at the second edge of the second blade.

* * * * *